US011332800B2

(12) United States Patent
Radlmayr

(10) Patent No.: US 11,332,800 B2
(45) Date of Patent: May 17, 2022

(54) METHOD AND DEVICE FOR FORMING AND HARDENING STEEL MATERIALS

(71) Applicant: voestalpine Metal Forming GmbH, Krems an der Donau (AT)

(72) Inventor: Karl Michael Radlmayr, Steyregg (AT)

(73) Assignee: voestalpine Metal Forming GmbH, Krems an der Donau (AT)

( * ) Notice: Subject to any disclaimer, the term of this patent is extended or adjusted under 35 U.S.C. 154(b) by 327 days.

(21) Appl. No.: 16/324,196

(22) PCT Filed: Jun. 29, 2017

(86) PCT No.: PCT/EP2017/066077
§ 371 (c)(1),
(2) Date: Feb. 8, 2019

(87) PCT Pub. No.: WO2018/028877
PCT Pub. Date: Feb. 15, 2018

(65) Prior Publication Data

US 2019/0177812 A1 Jun. 13, 2019

(30) Foreign Application Priority Data

Aug. 8, 2016 (DE) ..... 10 2016 114 658.7

(51) Int. Cl.
*C21D 9/08* (2006.01)
*B21D 26/033* (2011.01)
(Continued)

(52) U.S. Cl.
CPC ..... *C21D 9/08* (2013.01); *B21D 26/033* (2013.01); *C21D 7/13* (2013.01); *C21D 8/10* (2013.01);
(Continued)

(58) Field of Classification Search
CPC ... C21D 9/08; C21D 7/13; C21D 8/10; B21D 26/033
See application file for complete search history.

(56) References Cited

U.S. PATENT DOCUMENTS 6,067,831 A * 5/2000 Amborn ..... B21D 26/033 29/421.1
6,261,392 B1 * 7/2001 Sundgren ..... B21D 26/033 148/590
(Continued)

FOREIGN PATENT DOCUMENTS

DE 698 03 588 T2 6/2002
DE 10 2004 054 795 B4 4/2007
(Continued)

OTHER PUBLICATIONS

Wetzel ("Batch Hot Dip Galvanized Coatings", ASM Handbook vol. 5, 1994) (Year: 1994).*
(Continued)

*Primary Examiner* — Robert S Jones, Jr.
*Assistant Examiner* — Jiangtian Xu
(74) *Attorney, Agent, or Firm* — Saliwanchik, Lloyd & Eisenschenk

(57) ABSTRACT

The invention relates to a method for internal high-pressure forming and hardening of galvanized pipes made of sheet steel in which a pre-fabricated pipe is used; the pipe has at least one inlet opening (5) and a cavity (4); the pipe is heated to a temperature above the austenitization temperature ($AC_3$) of the respective steel alloy and after the achievement of a desired degree of austenitization, is inserted into an internal high-pressure forming tool and acted on with a pressurized medium, which is forced into the cavity (4) through the at least one inlet opening (5) until the pipe fills a predetermined mold (2) of the tool, characterized in that the forming tool is heated to a temperature between 400 and
(Continued)

650° C., in particular 450-550° C., and the pressurized medium is likewise heated and has a temperature of 400-650° C.; after the austenitization, the pipe is allowed to passively cool or is actively cooled to a temperature of 400-600° C., but a temperature above the martensite starting temperature (Ms) of the selected steel alloy, and the cooling of the pipe for hardening purposes only takes place after the removal from the mold.

8 Claims, 1 Drawing Sheet

(51) Int. Cl.
*C21D 7/13* (2006.01)
*C21D 8/10* (2006.01)

(52) U.S. Cl.
CPC ..... *C21D 8/105* (2013.01); *C21D 2211/008* (2013.01)

(56) References Cited

U.S. PATENT DOCUMENTS 6,299,709 B1 * 10/2001 Lundstrom ..... C21D 1/18 148/648
7,266,982 B1 * 9/2007 Guza ..... B21D 26/02 29/421.1
7,285,761 B1 * 10/2007 Terziakin ..... B23K 13/01 219/633
2016/0102380 A1 * 4/2016 Tabata ..... C22C 38/06 148/661
2016/0160307 A1 6/2016 Arai et al.
2018/0171424 A1 * 6/2018 Braun ..... C21D 8/0405

FOREIGN PATENT DOCUMENTS

DE 10 2007 043 154 A1 4/2009
DE 10 2006 020 623 B4 4/2010
DE 10 2007 018 395 B4 2/2011
DE 10 2009 040 935 B4 3/2013
EP 1 015 645 B1 1/2002
KR 10-2014-0002264 A 1/2014

OTHER PUBLICATIONS

International Search Report dated Sep. 7, 2017 in International Application No. PCT/EP2017/066077.
Chu, G. N. et al., "Hot Hydroforming of 22MnB5 Tube by Resistance Heating," *Journal of Metals*, May 10, 2016, 68(7):1983-1989, The Minerals, Metals & Materials Society.
Keigler, M. et al., "Enhancing the formability of aluminium components via temperature controlled hydroforming," *Journal of Materials Processing Technology*, 2005, 167:363-370, Elsevier B.V.

* cited by examiner

METHOD AND DEVICE FOR FORMING AND HARDENING STEEL MATERIALS

CROSS-REFERENCE TO RELATED APPLICATIONS

This application is the U.S. national stage application of International Patent Application No. PCT/EP2017/066077, filed Jun. 29, 2017, which claims the benefit under 35 U.S.C. § 119 of German Application No. 10 2016 114 658.7, filed Aug. 8, 2016, the disclosures of each of which are incorporated herein by reference in their entirety.

The invention relates to a method for forming and hardening steel materials.

Hardened steel components, particularly in vehicle body construction for motor vehicles, have the advantage that due to their outstanding mechanical properties, it is possible to achieve a particularly stable passenger compartment without having to use components that are much more massive at normal strengths and must therefore be embodied as much heavier.

To produce hardened steel components of this kind, steel types are used that can be hardened by means of a quench hardening. Steel types of this kind include, for example, boron-alloyed manganese steels, the most widely-used of these being 22MnB5. But other boron-alloyed manganese carbon steels are also used for this purpose.

In order to produce hardened components from these types of steel, the steel material must be heated to the austenitization temperature ($>Ac_3$) and it is necessary to wait until the steel material is austenitized. Depending on the desired degree of hardness, partial or complete austenitization can be achieved in this connection.

If after the austenitization, such a steel material is cooled at a speed that is above the critical hardening speed, then the austenitic structure converts into a martensitic, very hard structure. In this way, it is possible to achieve tensile strengths $R_m$ of up to over 1500 MPa.

Currently, two different procedural approaches are commonly used for producing steel components.

In so-called form hardening, a sheet steel blank is detached from a steel band, for example cut out or stamped out from it, and then—using a conventional, for example five-step, deep drawing process—is deep drawn to produce the finished component. This finished component in this case is dimensioned somewhat smaller in order to compensate for a subsequent thermal expansion during the austenitization.

The component produced in this way is austenitized and then inserted into a form hardening tool in which it is pressed, but is not formed or is only formed to a very slight extent and by means of the pressing, the heat flows out of the component and into the press tool, specifically at the speed greater than the critical hardening speed.

The other procedural approach is so-called press hardening in which a blank is detached from a sheet steel band, for example cut out or stamped out from it, then the blank is austenitized and the hot blank is formed at a temperature below 782° C. in a preferably one-stage step and at the same time, is cooled at a speed greater than the critical hardening speed.

In both cases, it is possible to use blanks provided with metallic anticorrosion coatings e.g. with zinc or a zinc-based alloy. Form hardening is also referred to as the indirect process and press hardening is referred to as the direct process. The advantage of the indirect process is that it is possible to achieve more complex tool geometries.

The advantage of the direct method is that a higher material utilization ratio can be achieved. But the achievable component complexity is lower, especially with the one-stage forming process.

It is also known to form sheet steel components in that a cavity is formed and, using a pressurized medium, this cavity is blown or inflated into a desired form or into a form that is necessary in order to achieve a final form. This method is also referred to as internal high-pressure forming.

DE 10 2009 040 935 B4 has disclosed a method for producing components; at least two individual parts are soldered or welded to form a semi-finished product and then the semi-finished product is hot formed; a cavity of the semi-finished product is or can be closed and the semi-finished product that has been heated to the austenitization temperature is expanded against the inner walls of a mold by means of a pressurized medium that is introduced into the cavity.

The necessary quenching for hardening purposes should be carried out by means of a cooling medium and the cooling medium that is used for the quenching can be conveyed through the cavity of the semi-finished product.

EP 1 015 645 B1 has disclosed a method for producing beveled thin-walled hollow metal housings by means of blow-molding; here, too, a heating to above the austenitization temperature is performed and the hollow structure is expanded against the inner walls of the mold by introducing a heated, pressurized medium into the interior of the cavity of the hollow housing; and in a subsequent step, the formed hollow housing is rapidly cooled in a procedure for producing a hardening. In this case, the dominant heated medium in the hollow housing is replaced by a pressurized cooling medium.

DE 10 2004 054 795 B4 has disclosed a method for producing vehicle components and body components; a composite material made up of two sheets that are joined to each other is subjected to at least one forming procedure; the composite material is hot formed and at least one hardenable pre-alloyed sheet undergoes an in-situ press hardening when the mold halves are closed.

DE 10 2006 020 623 B4 has disclosed a method for producing components out of so-called tailored blanks in which during the process, the semi-finished product is inserted into a forming tool and the semi-finished product consists of at least two at least partially overlapping sheets; a hardenable steel alloy is used for one sheet of the semi-finished product; in a heating station, the semi-finished product is heated to a temperature above the austenitization temperature of the alloy; and before the insertion into the press or inside the press, the sheets are affixed to each other by means of a forging procedure.

DE 10 2007 018 395 B4 has disclosed an internal high-pressure forming method in which a hollow structure made of hardenable steel sheets is expanded by a pressurized gas that flows into the inner chamber between the sheets; the workpiece is positioned in a cooled forming tool and the workpiece is formed in one stroke by the pressure of the gas and, by means of the temperature of this gas from the inside and the temperature of the forming tool from the outside, is formed and hardened in the same tool; the gas pressure in the workpiece is produced by relative movement of a top part of the press and the flow direction of the forming tool and is amplified by a pressure booster.

DE 10 2007 043 154 A1 has disclosed a method and apparatus for hardening profiles. This method is particularly embodied for open profiles; the component is heated, at least in some regions, to a temperature above the austenitization temperature of the base material and after the heating, the component is cooled at a speed above the critical hardening speed; the energy required for the heating is introduced at least partially by means of induction; free edges are positioned in the component for adjusting a temperature and/or hardness gradient by means of the cross-section of the component; the size, type, and dimensions of the edges are provided in such a way that they are calibrated to a desired hardness gradient and/or hardness gradient. These edges have the effect that during inductive heating, an increase in the current flux density occurs at the edges so that in these regions, the heating can be selectively performed very quickly, at least more quickly than in other regions.

DE 698 035 88 T2 has disclosed a method for producing beveled, hollow housings out of steel material by blow-molding; a preheated hollow housing block that is preferably above the austenitization temperature is inserted into a blow mold and formed by being expanded against the inner walls of the mold by a heated pressurized medium that is forced into the inner cavity of the hollow housing; in a subsequent step, the hollow housing is cooled rapidly in a procedure that is suitable for quenching the steel material in that the heated medium that is present in the hollow housing is replaced by a pressurized cooling medium and in that a cooling medium is conveyed through the mold in order to thus produce a cooling action.

The object of the invention is to create a method for forming and hardening galvanized steel pipes that can reliably produce crack-free hardened steel pipes.

This object is attained with a method having the features of claim 1.

Up to this point, internal high-pressure forming methods have been unable to form and harden galvanized pipes without producing microcracks. If such galvanized pipes or piping components are subjected to internal high-pressure forming, this always results in a very large amount of microcracking so that by contrast with other forming methods, it has not been possible to use the press hardening method or form hardening method for piping components.

The inventors have discovered that the microcrack-free forming of piping components is possible if a special temperature control and process control are carried out.

According to the invention, piping components of this kind are prefabricated and, analogously to the known internal high-pressure forming method, are pre-bent, pre-quenched, or pre-formed in some other way.

Then, these pipes are austenitized, which means that they are brought to a temperature above $AC_3$ and kept at this temperature until a desired degree of austenitization is achieved.

According to the invention, the pipe is then allowed to cool passively or is forcibly cooled actively to temperatures between 400 and 650° C.

This cooling can be carried out in that the component is transferred into the internal high-pressure forming tool and in the process, is passively cooled in the air or possibly, after the austenitization furnace, the tool is actively cooled for example by being blown or sprayed with suitable cooling mediums and is then transferred into the internal high-pressure forming tool.

Such an active cooling takes place at a cooling speed >5 K/sec, preferably >10 K/sec, particularly preferably >20 K/sec.

Then the pipe undergoes final forming in which a pressurized medium is forced into the pipe so that an intrinsically known internal high-pressure forming is achieved.

According to the invention, however, this forming is carried out with a temperature-controlled medium. In this case, the medium has a temperature of 400-650° C., for example. According to the invention, it has specifically turned out that when a medium that is too cold is used, parts of the pipe already undergo a hardening before the final forming has taken place. This means that a complete removal from the mold is hindered. Consequently, the forming is carried out with a temperature-controlled medium; the temperature-controlled medium preferably has a temperature that corresponds to the temperature of the pipe, which is to be formed, and is at least high enough that the martensite starting temperature (Ms) of the steel alloy used is exceeded.

According to the invention, the hardening then takes place; the hardening according to the invention can be carried out in different ways.

Figure 2:
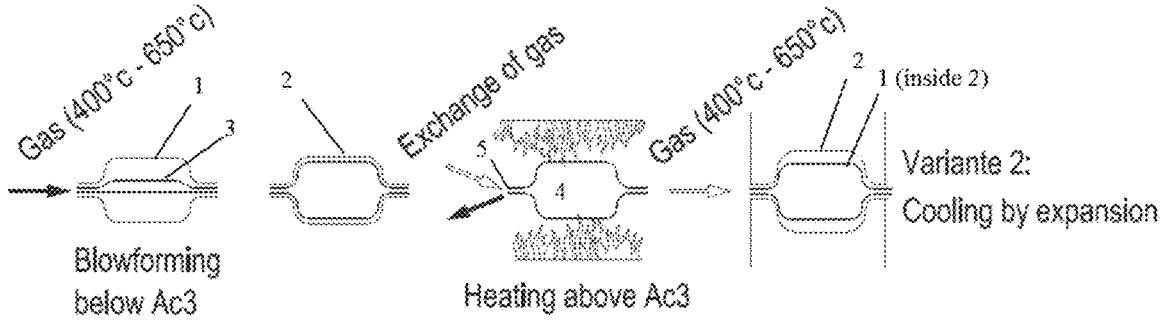
FIG. 2 shows a process flow of a method for internal high-pressure forming and hardening of a galvanized pipe, according to an embodiment of the subject invention.

In a first variant according to the invention, the internal high-pressure forming takes place in a hot tool with the hot pressurized forming medium. Then the component that has been formed in this way is removed from the tool and allowed to passively cool in the air if the cooling in the air is enough to reach the critical cooling speed of the steel material so that a martensitic hardening is assured. This process is illustrated in FIG. 2.

This passive cooling primarily depends on the sheet thickness with thinner sheet thicknesses of approximately 1 mm, a passive cooling in the air can be enough to reach the critical cooling speed.

With a sheet thickness of 3 mm, for example, an active cooling with suitable cooling means can be required in order reach this cooling speed.

Figure 1:
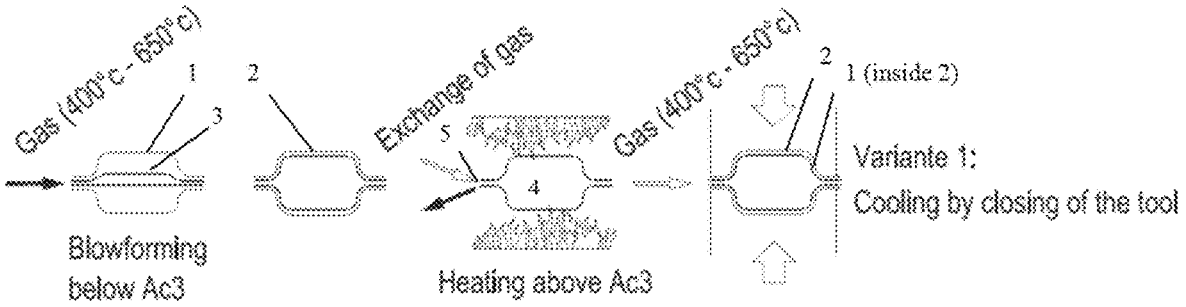
FIG. 1 shows a process flow of a method for internal high-pressure forming and hardening of a galvanized pipe, according to an embodiment of the subject invention.

In a second variant according to the invention, the internal high-pressure forming once again takes place in a hot tool with the hot pressurized forming medium and then the pipe is transferred into a cold form hardening tool. In this cold form hardening tool, the contour of the tool cavity corresponds exactly to the outer contour of the pipe so that when the tool is closed, the tool rests against the entire surface of the pipe on all sides and a quench hardening is achieved as a result. For the purposes of the invention, "cold" means that the temperature is at least 50° C. below the martensite starting temperature of the chosen steel material, i.e. Ms−50° C. This process is illustrated in FIG. 1.

In another variant according to the invention, the forming takes place in the hot tool with the aid of the hot pressurized forming medium, but after the forming is completed, a cold medium is conveyed through the pipe so that the cooling with the cold medium achieves the martensitic hardening by exceeding the critical cooling speed. In this case, it is technologically possible to carry out the internal high-pressure forming procedure with a pressurized, hot gaseous medium and to carry out the quenching procedure with a cold gaseous medium or also with a liquid cold medium. Here, too, the temperature of the cold medium is preferably below the martensite starting temperature of the material, i.e. Ms−50° C.

To achieve this, the pipes generally have an inlet and an outlet.

For purposes of the invention, pipes are understood not only to be cylindrical pipes, but also to be any form of elongated hollow bodies made of sheet steel, in particular structural components, longitudinal members, reinforcing members, rocker panels, and similar structural components, particularly of motor vehicles.

According to the invention, a material is used, which, like the materials of the prior art, is hardenable and in particular, is a hardenable boron/manganese steel such as a steel material of the 22MnB5 or 20MnB8 type or the like.

Sheet steels of this kind can be provided with a zinc layer, a zinc alloy layer, and in particular, a zinc/iron layer.

In particular, a so-called galvannealed coating is provided, i.e. a zinc coating on a sheet steel, which coating is pre-reacted by means of tempering, consists of zinc/iron phases, and can also withstand the blowing-in by means of a pressurized medium.

The invention will be explained by way of example based on FIGS. 1 and 2. FIGS. 1 and 2 show the process sequence with the two variants of the method.

Referring to FIGS. 1 and 2, an austenitized pipe 1 is inserted into a mold 2; for example, the pipe 1 is assembled from two sheets 3; in the region of a gas inlet and gas outlet of a cavity 4 that is formed by the sheets, the sheets each have a corresponding inlet opening 5. After temperature-controlled gas, for example a gas whose temperature has been adjusted to 400-650° C., has been dispensed into the cavity 4, the pipe 1 expands into the mold 2 so that the fully pre-formed blank is produced. The invention has the advantage of being able to reliably produce microcrack-free tubular components out of hardenable steel with a zinc coating.

The invention claimed is:

1. A method for internal high-pressure forming and hardening of galvanized pipes made of sheet steel in which a partially-shaped pipe is used; the pipe having at least one inlet opening (5) and a cavity (4), comprising: heating the entire pipe to a temperature above the austenitization temperature ($AC_3$) of a respective steel alloy and, after the achievement of a desired degree of austenitization, which varies depending on a desired final hardness level, inserting the pipe into an internal high-pressure forming tool where the pipe is acted on with a pressurized medium, which is forced into the cavity (4) through the at least one inlet opening (5) until the pipe fills a hot mold (2) of the tool, the forming tool having been heated to a temperature between 400 and 650° C. and the pressurized medium having been also heated and having a temperature of 400-650° C.; and, after the austenitization, cooling the pipe to a temperature of 400-600° C., but a temperature above the martensite starting temperature (Ms) of the respective steel alloy; and removing the pipe from the hot mold before further cooling of the pipe for hardening purposes, wherein after heating the entire pipe and before inserting the pipe into the internal high-pressure forming tool, the entire pipe is actively cooled by being blown or sprayed with a cooling medium to cool the pipe at a cooling speed of more than 20 K/s.

2. The method according to claim 1, further comprising: after removing the pipe from the hot mold, allowing the entire pipe to passively cool in the air.

3. The method according to claim 1, further comprising: after removing the pipe from the hot mold, transferring the pipe into a cold mold where a cavity of the cold mold corresponds to the outer contour of the pipe after removal from the tool.

4. The method according to claim 1, further comprising: after forming the pipe in the hot mold, retaining the pipe in the tool and rinsing the entire pipe with a cold cooling medium.

5. The method according to claim 3, wherein the temperature of the cold mold is at least 50° C. below the martensite starting temperature of the pipe when the pipe is transferred into the cold mold.

6. The method according to claim 1, wherein after removing the pipe from the hot mold, the entire pipe is passively cooled by cooling in natural air if the pipe sheet thickness is 1 mm or less, and the entire pipe is actively cooled by being blown or sprayed with a cooling medium if the pipe sheet thickness is 1.5 mm or more.

7. The method according to claim 1, wherein the pipe comprises a hardenable boron/manganese steel.

8. The method according to claim 1, wherein the steel material comprises a metallic coating including a zinc layer, a zinc alloy layer, an aluminum layer, an aluminum alloy layer, or a zinc/iron layer.

* * * * *